United States Patent [19]

Browne et al.

[11] Patent Number: 4,460,001

[45] Date of Patent: Jul. 17, 1984

[54] PROCESS FOR PREPARING COMPOUND FILTER

[75] Inventors: Colin L. Browne, Clover, S.C.; Charles H. Keith; Peter J. Bohlander, both of Charlotte, N.C.

[73] Assignee: Celanese Corporation, New York, N.Y.

[21] Appl. No.: 410,272

[22] Filed: Aug. 23, 1982

Related U.S. Application Data

[62] Division of Ser. No. 185,058, Sep. 8, 1980, abandoned.

[51] Int. Cl.[3] ..... A24D 3/04

[52] U.S. Cl. ..... 131/338; 131/340; 131/341

[58] Field of Search ..... 131/67-69, 131/66 R, 331, 338, 339, 340, 341

[56] References Cited

U.S. PATENT DOCUMENTS

| | | | |
|---|---|---|---|
| 2,954,772 | 10/1960 | Lebert | 131/339 |
| 2,954,778 | 10/1960 | Lebert | 131/339 |
| 2,954,786 | 10/1960 | Lebert | 131/339 |
| 4,091,821 | 5/1978 | Scorzo | 131/349 |
| 4,197,863 | 4/1980 | Clayton et al. | 131/340 |
| 4,219,033 | 8/1980 | Horsewell et al. | 131/339 |

*Primary Examiner*—V. Millin

*Attorney, Agent, or Firm*—Robert J. Blanke

[57] ABSTRACT

A process for preparing a compound cigarette filter, the filter having the ability to deliver substantially constant tar and nicotine as the cigarette is smoked. The compound filter comprises a barrier positioned upstream and in abutting relationship with at least one filter segment, the barrier containing passageways permitting the passage of smoke from a tobacco column to the filter segment, the total cross-sectional passageway area being from 0.5 to 3 square millimeters, the compound filter having an initial totally encapsulated pressure drop of at least 90 mm. $H_2O$.

3 Claims, 10 Drawing Figures

PROCESS FOR PREPARING COMPOUND FILTER

This is a division of application Ser. No. 185,058, filed Sept. 8, 1980, now abandoned.

This invention relates to the method of manufacturing a compound cigarette filter. More specifically, the invention relates to a compound cigarette filter system which provides substantially constant nicotine and tar delivery without increasing pressure drop to objectionably high levels.

A most important purpose of a tobacco smoke filter is to reduce the delivery of tar. It is well known that the tar delivery per puff of unfiltered and commercially available filter cigarettes increases as the cigarette is smoked down. Similarly, the delivery of nicotine and gaseous components is increased with a decrease in unsmoked tobacco column length. Consequently, the initial puffs from a cigarette have a different taste impact than the final puffs, the final puffs being generally stronger. In the case of particulate and condensible materials (tars) their increase is explained by condensation or filtration in the rear of the cigarette followed by reformation and/or revolatilization of the accumulation as the hot coal approaches. In the case of gases, the increase in concentration is due to less opportunity for diffusional exchange with atmospheric gases since the permeable paper surface of the cigarette decreases with smoking.

To accomplish the removal of particulate matter and undesirable gaseous components from a tobacco smoke stream, the smoke stream is generally traversed from one end of a cigarette filter to the other, the filter element generally being the same diameter as the tobacco part of the cigarette and varying from 15 to about 25 mm. in length. The pressure drop through this filter is determined by the material of construction, the packing density, the length and the diameter. The habits and taste of cigarette smokers indicate that the unlit pressure drop through a filter cigarette should be in the range of from 90 mm. of $H_2O$ to 200 mm. of $H_2O$. With a given material and a given construction of a cigarette filter, the ability of the filter to remove tar can be altered by changing the packing density, fineness of fiber, etc. However, the higher the initial tar removal, the higher the initial pressure drop and as the cigarette is consumed, the tar delivery per puff substantially increases.

Large bundles of crimped textile fibers, known in the trade as tows, have been used extensively for the manufacture of cigarette filters. The vast majority of cigarette filters currently made in the United States are manufactured from such tows. Among the properties of textile tows that make them desirable for this use are: (1) they can be processed into filters continuously at very high manufacturing speeds; (2) filters made from the tows are fairly effective for trapping nicotine and tar, and (3) by proper selection of fibers and fiber modifications or addition of additives, it is possible to selectively remove certain components from smoke.

Composite cigarette filters prepared in part from large bundles of crimped textile fibers are well known to the art, such filters commonly being designed so as to improve cigarette filter efficiency rather than provide cigarettes which deliver relatively constant quantities of nicotine and tar as the cigarette is smoked. Representative of prior art compositie cigarette filters are those filters set forth in U.S. Pat. No. 2,764,513, U.K. Pat. No. 1,436,636 and U.S. Pat. No. 3,648,712.

U.S. Pat. No. 2,764,513 discloses the incorporation in the mouth end portion of a cigarette of a perforated cross axial wall positioned some distance from the mouth end of the cigarette and also spaced from the tobacco within the cigarette wrapper. While filter materials may be positioned both upstream and downstream of the cross axial wall, the thrust of the invention is to cause the smoke to traverse a free air space region both prior and subsequent to contacting the perforated cross axial wall whereby the smoke stream is diffused and particulate matter builds up over the surface of the partition remote from the tobacco and about the perforation or perforations in such partition. No teaching is found of a filter having the ability to maintain substantially constant nicotine and tar delivery.

U.S. Pat. No. 3,648,712 discloses a compound filter comprised of a high gas permeability plug in combination with a low gas permeability disc. The combination of a small diameter filter disc with a conventional filtration plug results in a filter which has a relatively uniform pressure drop throughout smoking. The spacing around the disc reduces the pressure drop and permits the use of a lower permeability disc and thus produces greater filtration. No teaching is found of a filter having the ability to maintain substantially constant nicotine and tar delivery.

U.K. Pat. No. 1,436,636 discloses a tobacco smoking structure including a unitary insert positioned intermediate two filter elements having different draw resistances, the insert containing one or more venturi forming passageways. One of the filters may be positioned against the insert such that smoke emerging from the venturi-forming passageway impinges on the filter thereby causing tars to be deposited. The composite structure is not designed, however, so as to maintain substantially constant nicotine and tar delivery; that is to say, nicotine and tar delivery rise as the cigarette is smoked down.

It is therefore an object of this invention to provide an improved process for the preparation of a compound cigarette filter structure having the ability to provide the smoker with substantially constant nicotine and tar delivery.

In accordance with this invention, it has now been discovered that a substantially constant nicotine and tar delivery compound cigarette filter structure can be obtained by positioning upstream and in abutting relationship with at least one cigarette filter segment, a unitary barrier which may be either a wafer or a coating having from one to ten and preferably from three to five smoke permeable passageways extending therethrough. The total cross-sectional area of the passageway or passageways is from 0.5 to 3 and preferably from 1.9 to 2.5 square millimeters whereby on smoking, tar buildup downstream of said barrier produces increased blockage which results in increased pressure drop and filtration efficiency. The net effect of this blockage is that nicotine and tar delivery remain substantially constant. The compound filter must have an initial totally encapsulated pressure drop of at least 90 and preferably 100 mm. of $H_2O$. The barrier must be in abutting relationship with a downstream filter segment in order to cause particulate matter to concentrate in well defined areas of the downstream filter segment. If a gap is present between the barrier and the downstream filter segment, the particulate material will diffuse and the desired effect will not be obtained. Preferably, the barrier is a flat, concave or convex wafer of a smoke impervious material, however, it should be understood that for purposes of this invention that a smoke impervious coating may be deposited directly on the cigarette filter plug with the coating being subsequently apertured so as to have an opening or openings within the critical range of passageway cross sectional area. The thickness of the barrier is not critical, and is only dictated by ease of fabricating the compound filter. The preferred filter rod for purposes of this invention is a cellulose acetate tow filter rod having a denier per filament of from 1 to 12 and preferably 1.5 to 5 however, other filter structures may also be employed such as the paper filter segments disclosed in U.S. Pat. No. 3,466,358, the foamed cellulose acetate filter segments disclosed in U.S. Pat. No. 4,180,536 and the foamed polyolefin filter segments such as are disclosed in U.S. Pat. No. 4,180,523. While the compound filter of this invention is designed so that the pressure drop will substantially increase during the smoking process and may exceed the acceptable upper limit, it should be understood that the filter may be ventilated where a lower pressure drop is desired.

Pressure drop as reported herein is measured by the following method: Air is sucked through a 20 millimeter length of the fully encapsulated filter at a steady rate of 1050 milliliters per minute and the resulting pressure difference across the filter is measured by means of a water manometer. The result is expressed in millimeters of water gauge. In fabricating the compound filter of the instant invention, an apertured wafer may be mechanically inserted in abutting relationship with the upstream side of a filter rod segment. Preferably the wafer is positioned intermediate and in abutting relationship with two filter rod segments. Alternatively, the upstream end of a filter segment may be coated with a gas impervious hot melt coating and the coating subsequently apertured by drilling, punching or thermally perforating with a laser beam.

A better understanding of the invention and especially the critical relationship between the total cross sectional area of the passageway in the barrier may be had from a discussion of the drawings wherein.

Figure 1:
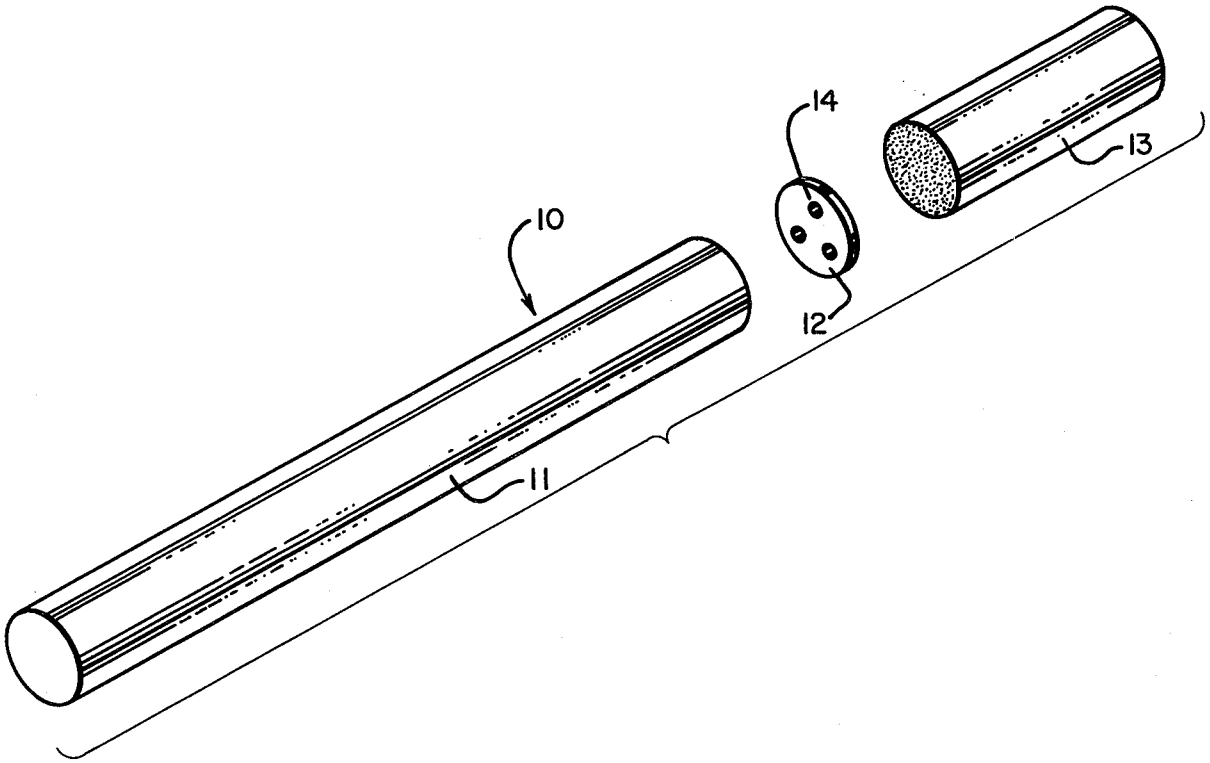
FIG. 1 is an exploded projected view, not to scale, of a cigarette having one embodiment of the compound filter of the instant invention.

Turning to FIG. 1 of the drawings, an exploded cigarette 10 is illustrated comprising a tobacco column 11 and a filter plug member 13 having a wafer member 12 positioned intermediate thereof. While for ease of illustration, cigarette 10 has been illustrated in exploded fashion, it should be understood that wafer member 12 is in abutting relationship with filter plug member 13. Wafer member 12 is provided with one or more apertures 14, whereby the passage of tobacco smoke is restricted to that area defined by apertures 14 and whereby tar is caused to accumulate on the filter plug member 13 in that area immediately adjacent to apertures 14.

Figure 2:
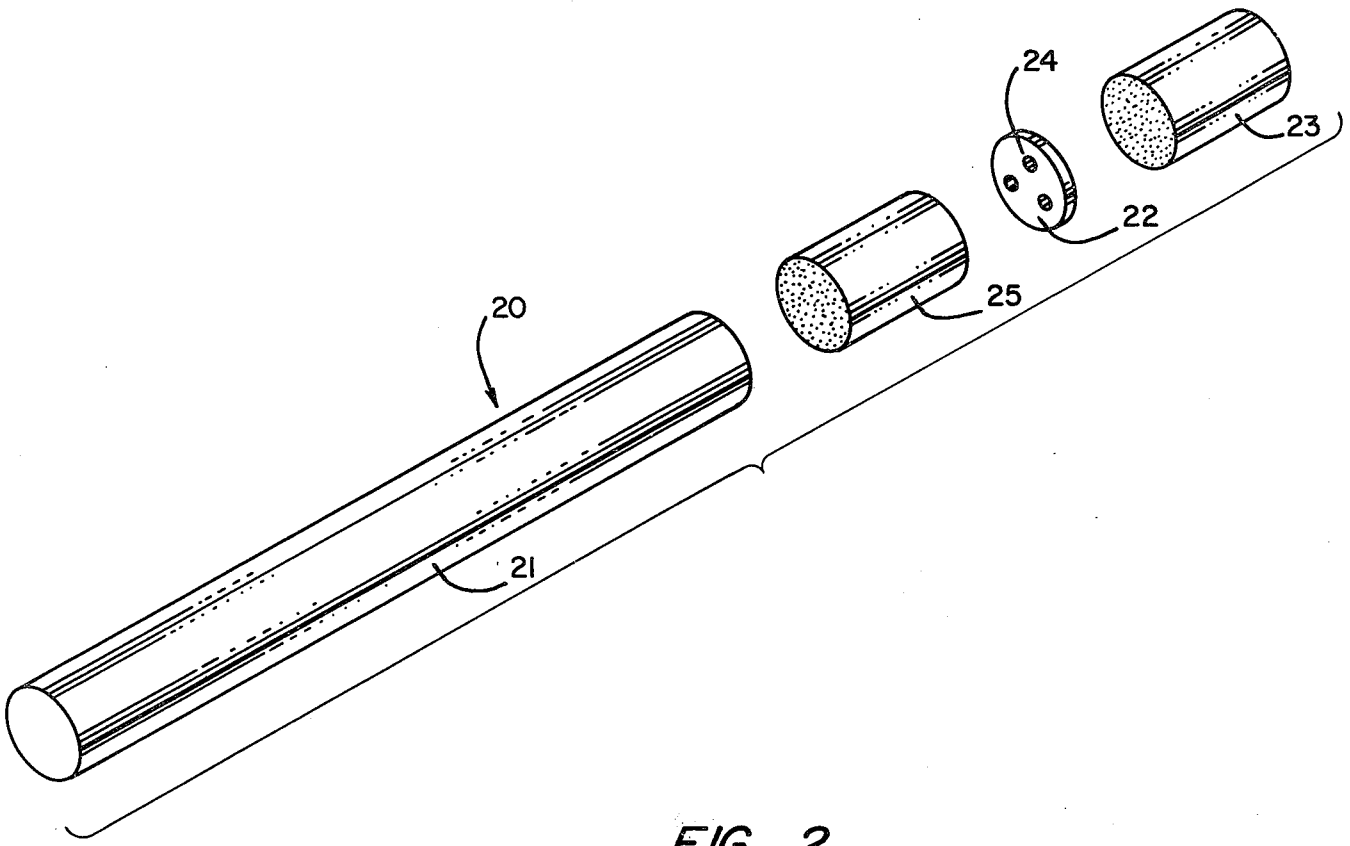
FIG. 2 is an exploded projected view, not to scale, of a cigarette having another embodiment of the compound filter of the instant invention.
Figure 3:
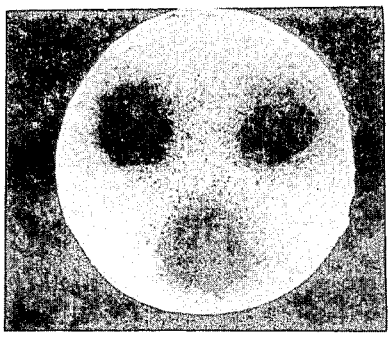
FIG. 3 is a photomicrograph magnified six times of a cellulose acetate filter rod segment removed from the compound wafer filter of this invention after four puffs.
Figure 4:
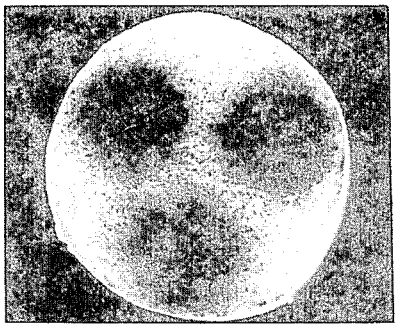
FIG. 4 is a photomicrograph magnified six times of a cellulose acetate filter rod segment removed from the compound wafer filter of this invention after eight puffs.
Figure 5:
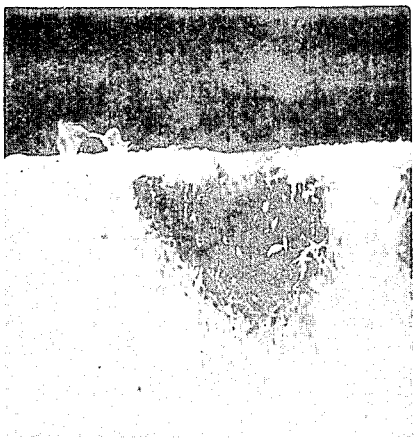
FIG. 5 is a photomicrograph magnified 12 times of a longitudinally sectional cellulose acetate filter rod segment removed from a cigarette employing the coated compound filter of this invention after 10 puffs.

Another embodiment of the compound filter of the instant invention may be seen in FIG. 2 of the drawings wherein a cigarette 20 is illustrated in exploded fashion. The cigarette 20 comprising a tobacco column 21 and an upstream filter plug member 25 and a downstream filter plug member 23. A wafer member 22 is positioned intermediate upstream filter plug member 25 and downstream filter plug member 23. While for ease of illustration cigarette 22 has been set forth in exploded fashion, it should be understood that wafer member 22 is in abutting relationship with upstream filter plug member 25 and downstream filter plug member 23. Wafer member 22 is provided with at least one aperture 24 whereby the passage of tobacco smoke is restricted to that area defined by the apertures 24 and whereby tar is caused to accumulate on the downstream filter plug member 23 in that area immediately adjacent to apertures 24. The tar buildup can readily be seen in FIGS. 3 and 4 which are photomicrographs of cellulose acetate filter plugs positioned downstream of the three apertured wafer member illustrated in FIGS. 1 and 2 of the drawings. FIG. 3 illustrates tar buildup after four puffs while FIG. 4 illustrates tar buildup after eight puffs. The tar buildup in the coated embodiment of the instant invention may also be seen in FIG. 5. Once more, tar buildup can be observed immediately adjacent to the apertures. As can be seen the critical area is that dark area which is immediately adjacent the exit apertures of the wafer or coated barrier member, the darkening area being the result of tar buildup during smoking of the cigarette possessing the filter of the instant invention. Tar buildup within the aperture itself is minimal and it has been determined that the buildup of the tar materials primarily occurs on the filter material abutting the aperture, thus, the effect of the instant invention is an "exit" effect.

In order to evaluate the compound filter of the instant invention, a regular filtered cigarette having a tobacco smoke column 65 mm. in length coupled to a 2.1 denier per filament, Y cross section, 42 thousand total denier cellulose acetate tow filter 20 mm. in length and a composite filter cigarette having a tobacco smoke column 65 mm. in length coupled to a compound filter comprising two 5 mm. long cellulose acetate tow segments having a 10 mm. long apertured wafer with 10,0.5 mm diameter apertures (total area 2.03 sq. mm) disposed in intermediate abutting relationship were tested for smoke delivery and pressure drop data, the result being as follows:

TABLE I

Physical and Chemical Properties of Cigarettes with Regular and Compound Filters

| | Prior Art | | Compound | |
|---|---|---|---|---|
| | 1–3 Puffs | 4–8 Puffs | 1–3 Puffs | 4–8 Puffs |
| Tar (mg/puff) | 1.20 | 1.56 | 1.40 | 1.24 |
| Nicotine (mg/puff) | 0.067 | 0.12 | 0.10 | 0.08 |
| Tip ΔP (mm) | 87 | | 87 | |
| Cigarette ΔP (mm) | 154 | | 163 | |
| Puff #1 ΔP (mm) | 221 | | 235 | |
| Puff #8 ΔP (mm) | 216 | | 353 | |
| Tar (mg/cig) | 11.4 | | 10.4 | |
| Nicotine (mg/cig) | 0.8 | | 0.7 | |

Figure 6:
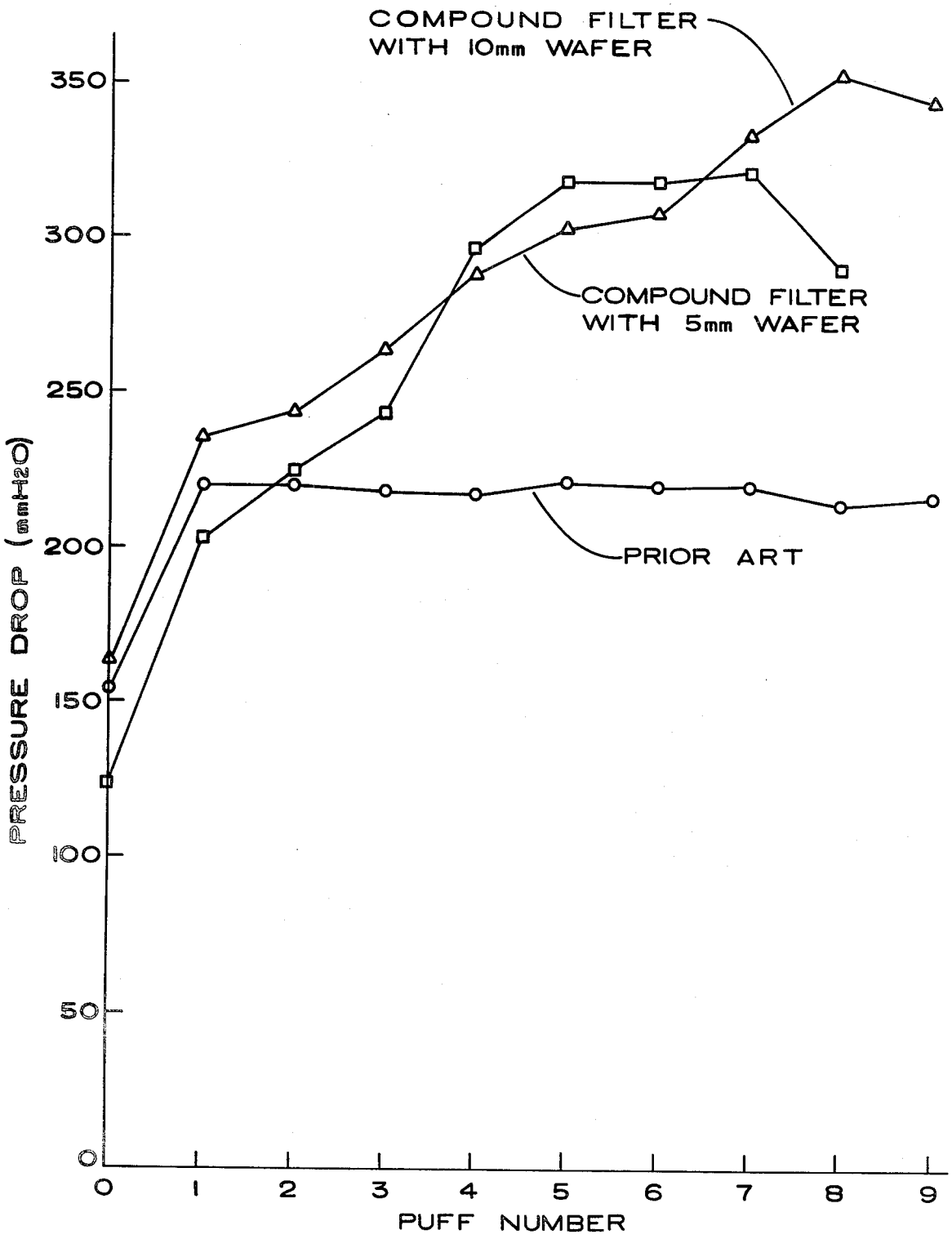
FIG. 6 is a graph illustrating smoking pressure drop profiles of unventillated filter cigarettes of the instant invention.

As can be seen in FIG. 6, when the data of Table I is plotted (puff number V. pressure drop), all of the cigarettes showed a 70–80 mm. increase in pressure drop with the lighting puff. This corresponds to the pressure drop of the coal. With further puffing, the pressure drop of the prior art filtered cigarette remained constant. The compound filter cigarette showed an increase in pressure drop of about 50% comparing first and eighth puffs. On examination of the compound filters after smoking, heavy deposits of tar were found on the fibers at the orifice or aperture exits. There was some tar deposition at the entrance to the orifice, but it was diffuse compared to that at the exit.

Turning back to the data of Table I, Table I includes smoke delivery data as well as pressure drop data. Cigarettes were smoked only three puffs in order to obtain average per puff delivery for early puffs. Other cigarettes were smoked eight puffs and the average per puff delivery for late puffs was obtained by subtracting the delivered material determined in the early puff test and dividing by five. In the case of the standard filter cigarette, strong increases were found in late per puff delivery for tar (30%) and nicotine (29%) compared to the first puffs. With the compound filter, slight decreases were found in the late puff deliveries of tar (−11%) and nicotine (−20%).

The data of Table I shows that it is possible to level out tar and nicotine deliveries along a cigarette by increasing its pressure drop and filtration efficiency as it is puffed. It should also be noted that the total tar and nicotine delivered by the compound filter cigarette is reduced only slightly (10–12%) compared to the standard filter, but that the initial deliveries per puff are higher while the latter puffs are lower compared to prior art filter cigarettes. In prior art filter cigarettes the large shift in the delivery will change the flavor perception during smoking.

Figure 7:
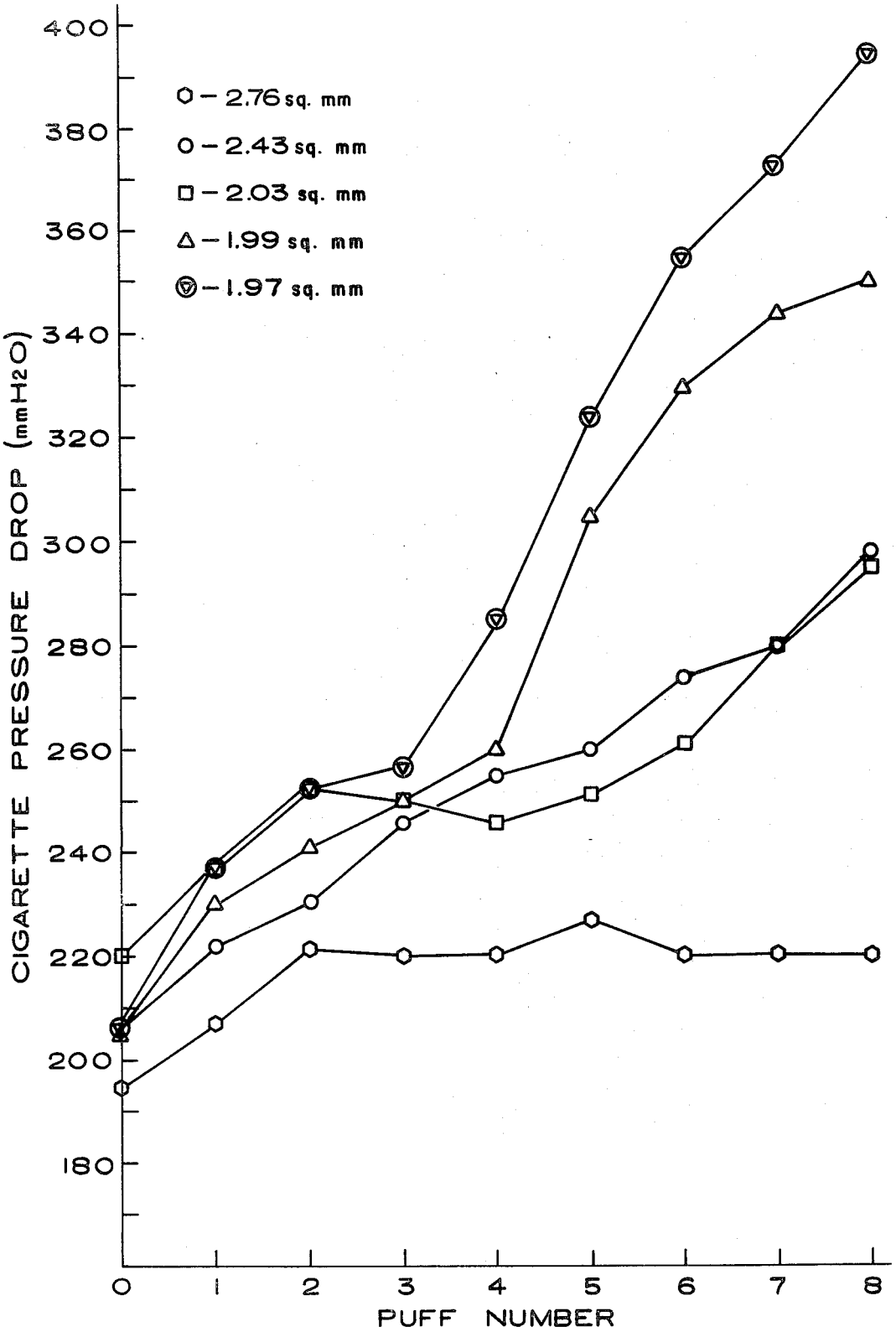
FIG. 7 is a graph illustrating smoking pressure drop profiles as a function of the total area of the apertures in a 1 mm. disc inserted between two 10 mm. filter rod segments.

The criticallity of the relationship between the pressure drop of the compound filter of this invention and the total cross sectional area of the apertures can be seen in FIG. 7 of the drawings. The data employed to plot FIG. 7 of the drawings was obtained by preparing cigarettes having a tobacco column 65 mm. in length joined to a two 4.2 denier per filament, Y cross section, 40,000 total denier cellulose acetate tow filter segments 10 mm. in length. The 10 mm Filter segments have a 1 mm. thick perforated wafer positioned intermediate thereof, the number and size of the apertures or perforations in the wafer being as reported in the following table designated as table II.

TABLE II

Determination of Effective Total Cross-Sectional Passageway Area 4.2Y/40000 filter item

| Total Open Cross-Sectional Area (sq. mm) | Number of Apertures | Individual Capillary Hole Diameter (mm) | Tip Pressure Drop With Capillary (mm) | Ending Cigarette Pressure Drop (mm) | Average Tar Delivery For Puffs 1–4 | Average Tar Delivery For Puffs 5–8 | Percentage Change In Tar Delivery 5–8/1–4 | Average Nicotine Delivery For Puffs 1–4 | Average Nicotine Delivery For Puffs 5–8 | Percentage Change In Nicotine Delivery 5–8/1–4 |
|---|---|---|---|---|---|---|---|---|---|---|
| 2.76 | 5 | .84 | 88 | 220 | 1.29 | 1.61 | +24.8 | .09 | .13 | +44.0 |
| 2.43 | 3 | 1.02 | 107 | 298 | 1.39 | 1.23 | −11.5 | .09 | .09 | — |
| 2.03 | 10 | .51 | 99 | 295 | 1.39 | 1.29 | −7.2 | .07 | .08 | +14.3 |
| 1.99 | 5 | .71 | 99 | 350 | 1.26 | 1.11 | −11.9 | .07 | .08 | +14.3 |
| 1.97 | 3 | .91 | 100 | 395 | 1.09 | .99 | −9.2 | .06 | .06 | — |
| 1.64 | 10 | .46 | 210 | Initial | Tip Pressure | Drop To | High To | Smoke | Adequately | |

As can be seen from FIG. 7 of the drawings, a total cross sectional aperture area of 2.76 sq. mm is too large to generate the increase in pressure drop necessary to obtain the desired effect of the instant invention. However, when a total cross sectional area of less than 1.9 sq. mm. is employed, the pressure drop rises to unacceptably high levels.

Figure 8:
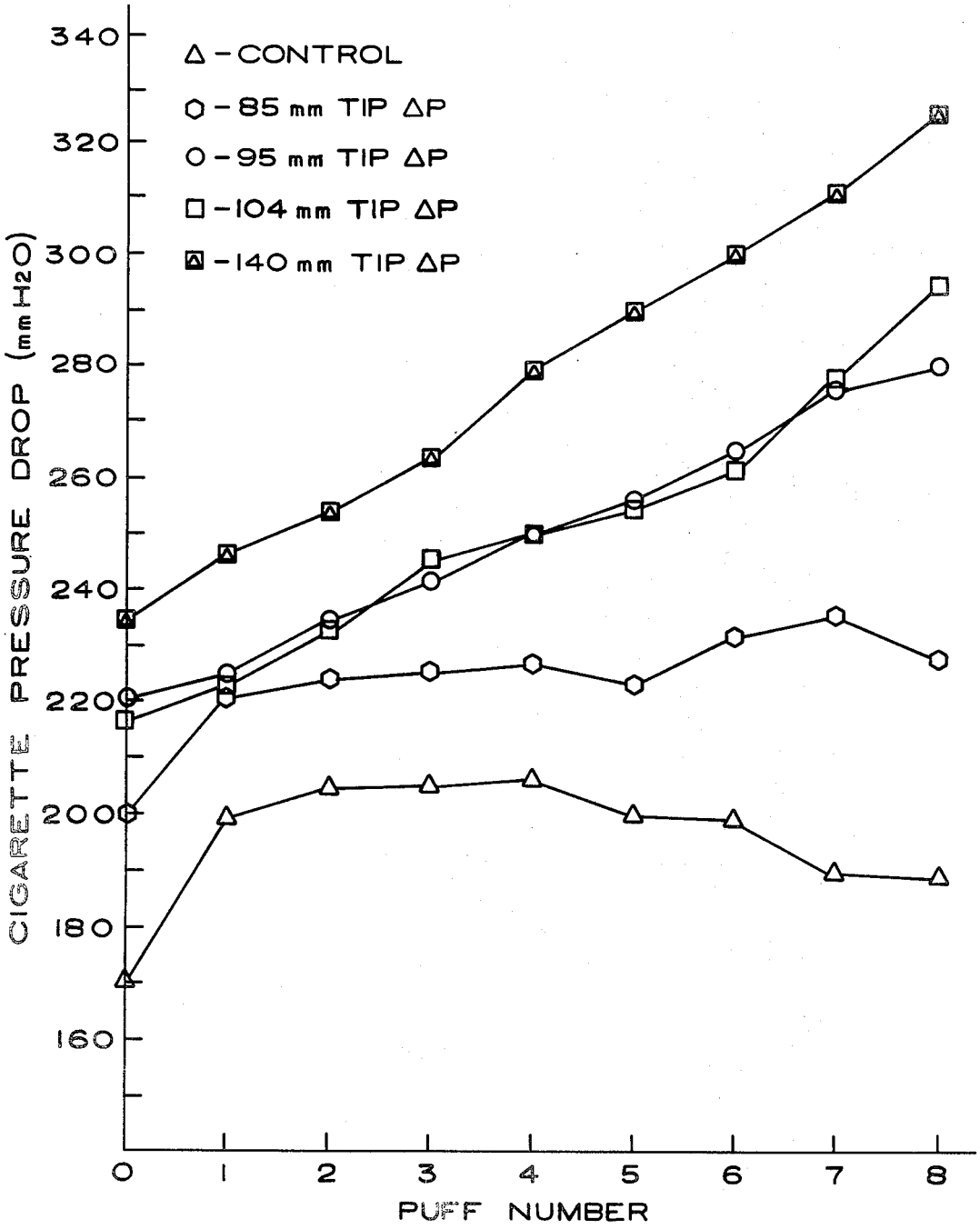
FIG. 8 is a graph of smoking profiles illustrating a minimum effective unlit tip pressure drop of the compound filter of this invention.

The criticallity of the minimum initial pressure drop of the compound filter of this invention can be seen in FIG. 8 of the drawings. The date employed to plot FIG. 8 of the drawings was obtained by preparing cigarettes having a tobacco smoke column 65 mm in length joined to cellulose acetate tow filter segments having varying pressure drops due to varying weights and varying rod making conditions. The particulars concerning each filter tow item being reported in table III. A wafer containing three 1.02 mm diameter holes is positioned intermediate the cellulose acetate filter tow segments. The pressure drop and nicotine and tar deliveries for these cigarettes is reported in table III.

TABLE III

DETERMINATION OF MINIMUM EFFECTIVE PRESSURE DROP
Wafer contained 3 × 1.02 mm. diameter holes
Total Open cross-sectional area = 2.43 sq. mm.

| Filter Tow Item | Tip Pressure Drop Without Wafer | Tip Pressure Drop With Wafer | Ending Cigarette Pressure Drop (mm) | Average Tar Delivery For Puffs 1–4 | Average Tar Delivery For Puffs 5–8 | Percentage Change In Tar Delivery 5–8 / 1–4 | Average Nicotine Delivery For Puffs 1–4 | Average Nicotine Delivery For Puffs 5–8 | Percentage Change In Nicotine Delivery 5–8 / 1–4 |
|---|---|---|---|---|---|---|---|---|---|
| 3.3Y/40000 | 61 | | 189 | 1.60 | 2.04 | +27.5 | .10 | .19 | +90.0 |
| 3.3Y/40000 | 42 | 85 | 227 | 1.23 | 1.53 | +24.4 | .10 | .13 | +30.0 |
| 3.3Y/40000 | 53 | 95 | 280 | 1.25 | 1.40 | +12.0 | .10 | .10 | — |
| 3.3Y/40000 | 61 | 104 | 294 | 1.28 | 1.38 | +7.8 | .10 | .08 | −2.0 |
| 3.3Y/53000 | 97 | 140 | 325 | 1.15 | 1.01 | −12.2 | .08 | .08 | — |

As can be seen in FIG. 8 of the drawing, an initial pressure drop of 85 mm does not achieve the required increase in pressure drop on smoking and accordingly an unacceptably high increase in tar delivery occurs.

Figure 9:
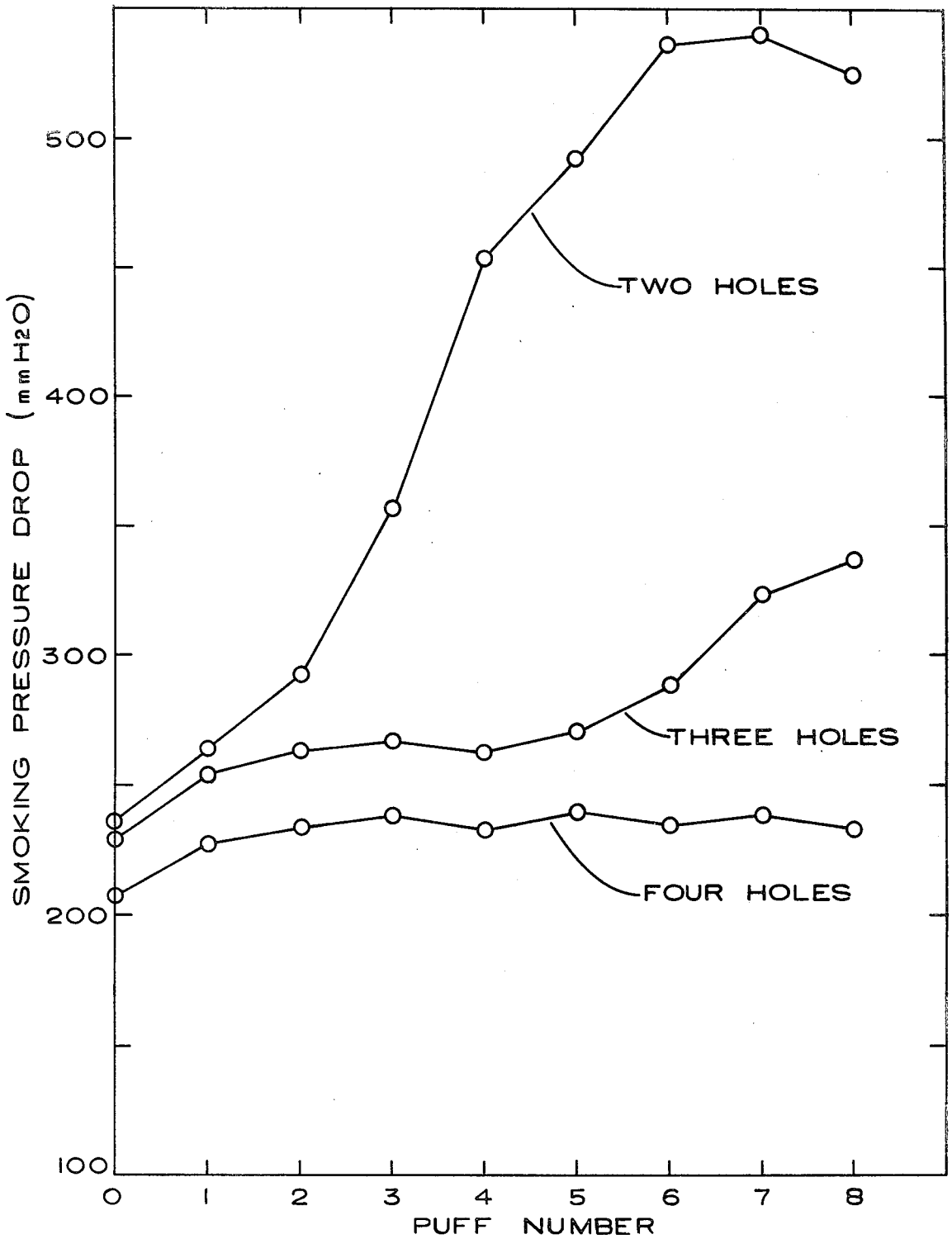
FIG. 9 is a graph illustrating smoking pressure drop profiles as a function of the number of 1 mm. apertures in the coated compound filter of this invention.

As previously noted, the compound filter of this invention may be obtained by coating the upstream end of a filter segment with a gas impervious coating and subsequently producing apertures in the coating. The coating must therefore be stiff and not rubbery in order to facilitate the formation of apertures. Preferably, the coating has a softening point of at least 80° C. and is selected from the group consisting of hydrocarbon waxes, polymer and copolymers of vinyl acetate and ethylene or propylene, polysacchrides and cellulose acetate as well as various combinations of the aformentioned materials. To illustrate the coated embodiment 20 mm. segments of 5 denier per filament y cross section, 40 thousand total denier cellulose acetate filter rods were prepared. The filter rod segments were further processed by: (1) contacting the ends of the filter segments with a film of molten hot melt adhesive on a glass plate, (2) allowing the applied adhesive to solidify, and (3) drilling holes 1 mm. in diameter through the adhesive coating. Only enough adhesive to seal the end of the filter was applied. This is a thickness of about 1 mm. or less. The adhesive used had a softening point of 80° C. and was a mixture of 80 parts paraffin waxes, 70 parts rosin derived from ester resins, 50 parts ethyl vinyl acetate and one part anti oxidant. FIG. 9 shows the effect on filter pressure drop of varying the number of 1 mm. diameter holes in the adhesive coating.

Figure 10:
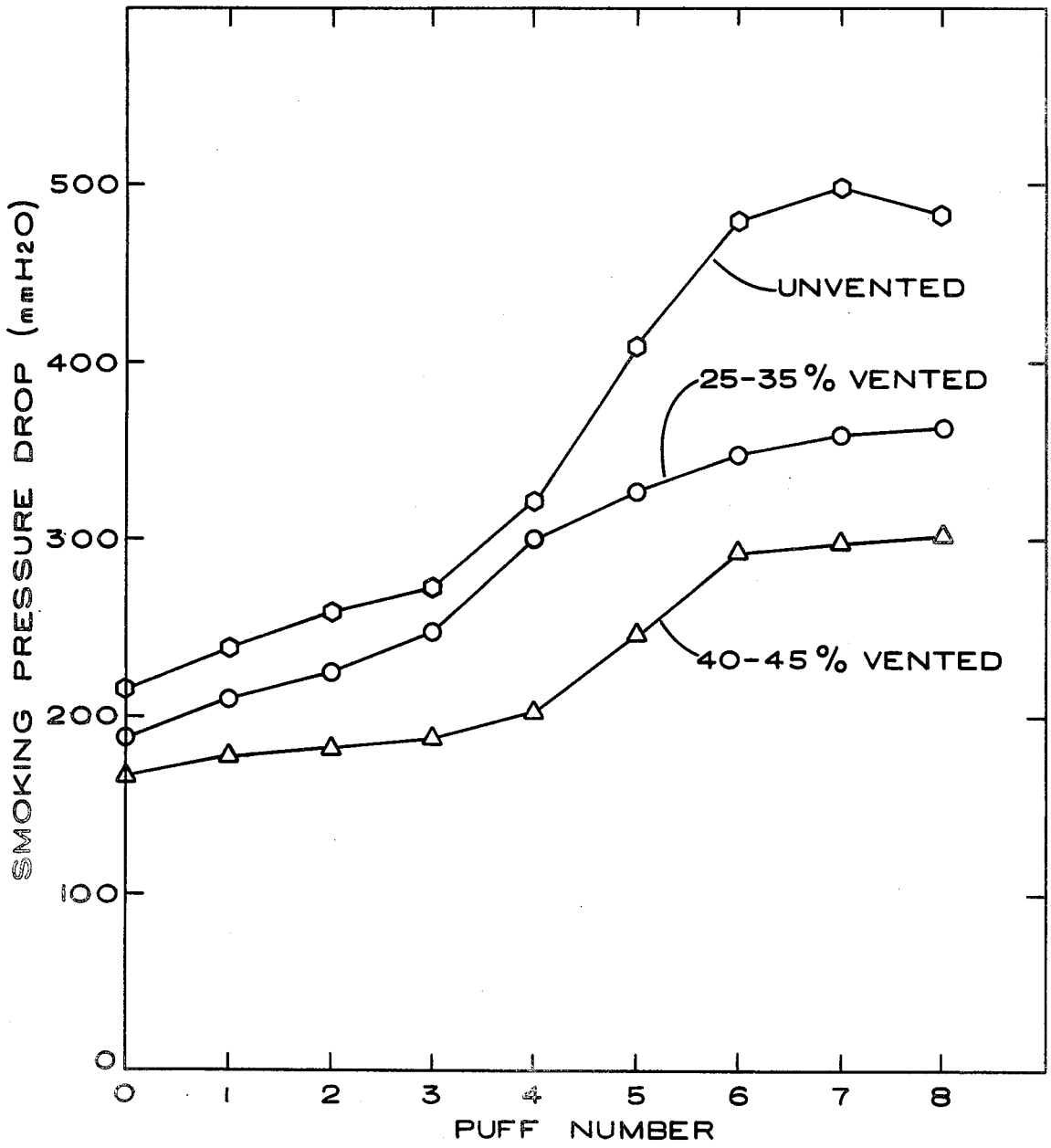
FIG. 10 is a graph illustrating smoking pressure drop profiles for vented and non-vented coated compound filter cigarettes of this invention.

For smoking tests, 20 mm. end coated tips of 5 denier per filament, Y cross section, 40 thousand total denier cellulose acetate tow were prepared with 2×1 mm. holes. An uncoated tip was prepared as a control representative of the prior art. These tips were assembled to 65 mm. standard tobacco columns for smoking. FIG. 10 shows the smoking pressure drop puff profiles. Without ventillation this tip more than doubles in pressure drop on smoking. To reduce the pressure drop build up, tips were ventilated with one or two holes made with a common pin giving air dilution levels of 27% and 43% respectively. Smoking pressure drop profiles are also shown in FIG. 9 for these ventilated tips. It can be seen that the pressure drop buildup is reduced with increasing ventilation. The tip with 27% dilution gave a suitable smoking pressure drop profile and was therefore tested for smoke delivery after four and eight puffs. The results are given in the following table.

TABLE IV

Particulate Deliveries of Pierced End-Coated Compound Filters

| | Puffs 1–4 | Puffs 5–8 | Change | Total (mg/cig) |
|---|---|---|---|---|
| A. Prior Art Control | | | | |
| Tar (mg/puff) | 1.76 | 2.43 | +38% | 16.7 |
| Nicotine | 0.10 | 0.16 | +60% | 1.04 |
| | | | | 2.00 |
| B. Pierced End Coated Compound Filter (27% ventillation) | | | | |
| Tar (mg/puff) | 0.55 | 0.53 | −4% | 4.3 |
| Nicotine | 0.029 | 0.029 | 0 | 0.23 |

In the case of the prior art control filter there are strong increases in both tar (38%) and nicotine (60%) per puff deliveries from the second half of the cigarette. With the end-coated filter, tar and nicotine deliveries are essentially constant through the cigarette. The combination of the compound filter and its ventilation give a low total tar delivery of 4.2 mg/cig compared to 16.7 mg/cig for the control.

Having thus disclosed the invention, what is claimed is:

1. A process for the preparation of a cigarette filter suitable for attachment to a tobacco column, said filter having an initially totally encapsulated pressure drop of at least 90 mm. $H_2O$, said process comprising coating the upstream end of a filter rod with a gas impervious coating and then forming one or more apertures in said coating to provide a smoke passageway having a total cross-sectional area of from 1.9 to 2.5 square milimeters, whereby on smoking, tar buildup downstream of said insert produces increasing pressure drop and substantially constant tar and nicotine delivery as the cigarette is smoked.

2. The process of claim 1 wherein said filter rod is a cellulose acetate tow filter rod.

3. The process of claim 2 wherein said filter rod is a filter rod selected from the group consisting of foamed cellulose acetate filter rods and foamed polypropylene filter rods.

* * * * *